United States Patent [19]

Slowski et al.

[11] Patent Number: 4,954,099

[45] Date of Patent: Sep. 4, 1990

[54] ELECTRODE RECEPTACLE

[75] Inventors: Wasyl Slowski; Darrel Slowski, both of Islington; David Slowski, Mississauga, all of Canada

[73] Assignee: Williams Sign Supplies Ltd., Mississauga, Canada

[21] Appl. No.: 306,387

[22] Filed: Feb. 6, 1989

Related U.S. Application Data

[63] Continuation of Ser. No. 923,198, Oct. 27, 1986, abandoned.

[51] Int. Cl.[5] ..... H01R 33/02

[52] U.S. Cl. ..... 439/244; 439/237; 439/934

[58] Field of Search ..... 439/226–244, 439/934

[56] References Cited

U.S. PATENT DOCUMENTS

| | | | |
|---|---|---|---|
| 3,539,969 | 11/1970 | Johnson et al. | 439/231 |
| 4,444,446 | 4/1984 | Hageman | 439/230 |
| 4,460,226 | 7/1984 | Hageman | 439/226 |

*Primary Examiner*—David L. Pirlot

[57] ABSTRACT

In an electrical receptacle having a generally hollow cylindrical section for receiving a high tension wire at one end and a neon tube at another end, said neon tube adapted for electrical connection with said high tension wire interiorally of said hollow cylindrical section, said hollow cylindrical section comprised of carbonate resin plastic for resisting sudden heat increases within said hollow cylindrical section in the region of said electrical contact with said neon tube and said high tension wire wherein said carbonate resin plastic has a melt flow of 9 to about 12 g/10 m at 300 degrees Centigrade and 1,200 g load and tensile stress at yield of 63 MPa, a tensile stress at break of 68 MPa, a delfection temperature under load at 1.8 MPa of 133 degrees Centigrade and a dielectric strength of greater than 16 KV/mm.

15 Claims, 1 Drawing Sheet

ELECTRODE RECEPTACLE

This is a continuation of application Ser. No. 06/923,198, filed 10/27/86 now abandoned.

FIELD OF INVENTION

This invention relates to electrode receptacles or sockets, and in particular relates to neon receptacles comprised of polycarbon plastic, and also relates to a stress relieved spring associated therewith.

BACKGROUND TO THE INVENTION

Displayed tubes such as neon signs are usually mounted in a display or sign housing supported on the exterior wall of a building and electrical connections are made through a conduit to a high tension wire extending through the conduit from the housing through the wall to the interior side of the wall to a power source. Electrodces are mounted on the opposite ends of a gas filled tube or neon sign and are adapted for connection to the ends of the high tension wires.

Since relatively high voltages in the vicinity of 7500 volts are utilized to excite the neon tubes an electrode receptacle or socket has been developed so as to avoid the manual engagement of the electrodes of the neon signs to the high tension wires.

Such electrode sockets usually comprise a cylindrical receptacle or socket which is adapted to be mounted within a cylindrical metal housing and which is adapted for mounting through the building wall on which the sign is mounted. One end of the receptacle which is mounted within the building wall includes a compression spring attached to an electrical contact which is connected to the high tension wires, while the other end of the electrode receptacle includes an opening to telescopingly receive the electrodes at the end of the neon tube for contact with the compression spring, electrical contacts and high tension wire at the other end of the electrode socket. Once the neon tube is inserted into the receptacle the compression spring is compressed so as to effect a good electrical contact. In this way, the elctrical connection to the tube is made within the interior of the electrode socket away from the manual engagement and the connection is made automatically upon insertion of the neon tube into the electrode receptacle.

the electrode receptacles have heretofore been from materials having high dielectric characteristics as insulators such as glass or porcelain.

For example, U.S. Pat. No. 1,872,593 discloses an electrode housing made of porcelain. U.S. Pat. No. 1,890,680 teaches a socket which consists of tubular glass or porcelain. Moreover U.S. Pat. No. 2,046,960 teaches the use of an insulator made of Pyrex type or Boro-Silicate glass composition. Finally, U.S. Pat. Nos. 2,486,497 and 2,561,954 show the use of a receptacle or socket made of glass.

The utilization of such fragile material as glass or procelain in the manufacture of electrode receptacles cause problems in the installation of same as glass or porcelain cracks if mishandled or over tightened. Furthermore, glass and porcelain crack due to changing weather conditions, temperature changes caused by seasonal changes as well as sudden surges of high voltages which vaporize water that tends to collect in the electrical receptacles.

When the glass or porcelain receptacles present cracks, the high electrical voltages leak out or "arc" outwardly through the crack thereby creating a potentially hazardous.

Furthermore, when a building which contains neon tubes is under fire, the severe temperature of the fire as well as the structural damage caused thereby frequently causes the glass or porcelain receptacles to break thereby exposing the high voltages and further creating a dangerous condition.

Also the compression springs used heretofore have a tendency to loose their compressibility or resiliency as a result of the turning on and off of neon tubes over an extended period of time. When neon tubes are turned on or excited by the application of the relatively high voltages the compression spring has a tendency to heat up and expand; and the compression spring has a tendency to cool off or contract when the neon tubes are turned off. Over time this repetitive expansion and contraction of the compression spring causes the spring to loose its resiliency or compressibility to such an extent that the spring may no longer contact the end of the neon tube since the neon tube is anchored to the building wall. When this condition is reached the high electrical voltages arc between the space between the compression spring and end of the neon tube, causing the neon tube to flicker on and off and the neon tube eventually fails. Furthermore the resulting arcing becomes a potential hazard.

OBJECTS OF THE INVENTION

It is an object of this invention to provide an electrode receptacle which exhibits improved strength characteristics against cracking.

It is a further object of this invention to provide an improved electrode receptacle which is less costly to produce than those of the prior art.

It is a further object of this invention to provide a more efficient compression spring utilized in the electrode receptable.

FEATURES OF THE INVENTION

One aspect of this invention resides in an electrical receptacle having a generally hollow cylindrical section for receiving a high tension wire at one end and a neon tube at another end, said neon tube adapted for electrical connection with said high tension wire interiorally of said hollow cylindrical section, said hollow cylindrical section comprised of carbonate resin plastic for resisting sudden heat increases within said hollow cylindrical section in the region of said electrical contact with said neon tube and said high tension wire wherein said carbonate resin plastic has a melt flow of 9 to about 12 g/10m at 300 degrees Centigrade and 1,200 g load and tensile stress at yield of 63 MPa, a tensile stress at break of 68 MPa, a deflection temperature under load at 1.8 MPa of 133 degrees Centigrade and a dielectric strength of greater than 16 KV/mm.

Another aspect of this invention resides in a neon receptacle for connecting a high voltage connector to a neon tube, said receptacle having a generally hollow cylindrical section for receiving said high voltage conductor at one end of said hollow cylindrical section and said neon tube at another end, said neon tube adapted for electrical contact with said high voltage conductor internally of said hollow cylindrical section, said hollow cylindrical section comprised of polycarbonate resin plastic for resisting sudden heat increases within said hollow cylindrical section in the region of said electrical contact between said neon tube and said high voltage conductor wherein said polycarbonate resin plastic has, a melt flow of about 9 to 12 g/10m at about 300 degrees Centigrade at about 1,200 g load, a tensile stress at yield of about 63 MPa, a tensile stress at break of about 68 MPa, a deflection temperature under load of about 1.8 MPa at about 133 degrees Centigrade and a dielectric strength of greater than 16 KV/mm.

Yet another aspect of this invention resides in a neon receptacle for connecting a high voltage conductor to a neon tube said receptacle including: a generally hollow cylindrical section, said section having an opening at one end thereof for receiving said neon tube and an aperture at the other end thereof adapted for receiving said high voltage conductor interiorly of said section; a compression spring disposed interiorly of said tube adapted for connection to said high voltage conductor for conducting electrical energy from said high voltage conductor to said neon tube; said hollow cylindrical section comprised of polycarbonate resin plastic for resisting sudden heat increases within said hollow cylindrical section in the region of said electrical contact between the said neon tube and said high voltage conductor; wherein said polycarbonate resin plastic has a density of 1.2 mg/m$^3$, melt flow rate of 9 to about 12 g/10m at 300 degrees Centigrade and 1,200 g load, and a tensile stress at yield of 63 MPa, a tensile stress at break of 68 MPa, a deflection temperature underload at 1.8 MPa of 133 degrees Centigrade and a dielectric strength of greater than 16 kV/mm.

Yet another aspect of this invention resides in a neon receptacle for connecting a high voltage conductor to a neon tube said receptacle including: a generally hollow cylindrical section, said section having an opening at one end thereof for receiving said neon tube and an aperture at the other end thereof adapted for receiving said high voltage conductor interiorally of said section; a compression spring disposed interiorally of said tube adapted for connection to said high voltage conductor for conducting electrical energy from said high voltage conductor to said neon tube; said hollow cylindrical section comprised of carbonate resin plastic for resisting sudden heat increases within said hollow cylindrical section in the region of said electrical contact between said neon tube and said high voltage conductor; said carbonate resin plastic having a density of 1.2 mg/m$^3$, melt flow rate of 9 to about 12 g/10m at 300 degrees Centigrade and 1,200 g load, and a tensile stress at yield of 63 MPa, a tensile stress at break of 68 MPa, a deflection temperature underload at 1.8 MPa of 133 degrees Centigrade and a dielectric strength of greater than 16 kV/mm.

DRAWINGS

These and other objects and features are illustrated and described in the following specification to be read in conjunction with the sheets of drawings in which.

DESCRITPION OF THE INVENTION

Identical parts have been given identical numbers throughout the Figures.

Figure 1:
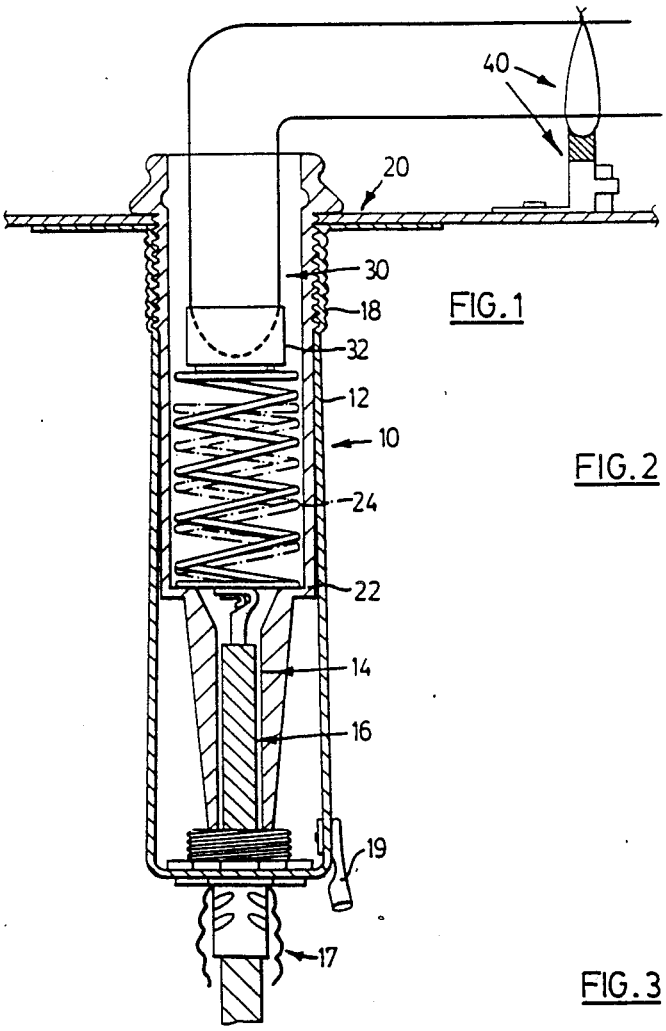
FIG. 1 is a cross sectional view of said electrode receptacle.

The electrode receptacle is generally illustrated as 10 in FIG. 1.

The electrode receptacle 10 comprises generally two hollow cylindrical sections 12 and 14 integrally connected to one another. Hollow cylindrical section 12 is larger in diameter than cylindrical section 14, and is adapted to receive at one end thereof the ends of a neon tube in a manner to be described more fully herein.

Figure 2:
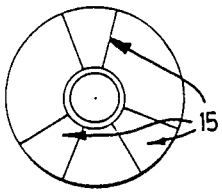
FIG. 2 is a bottom view of said electrode receptacle.
Figure 3:
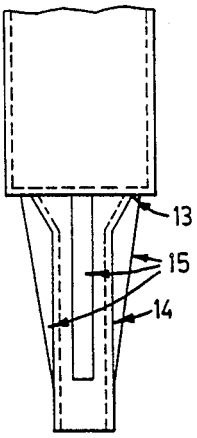
FIG. 3 is a partial side view of said electrode receptacle.

Hollow cylindrical section 14 is adapted to receive the high tension wire 16 through conduit 17. Hollow cylindrical section 14 contains three regidifying ribs 15 as best illustrated in FIG. 2.

The electrode receptacle 10 is adapted to be received by a metal sleeve 18 which is adapted to be mounted on the exterior of a building wall 20 as illustrated in FIG. 1. Alternatively, the metal sleeve 18 may be mounted in a sign housing (not shown) in a manner well known to those skilled in the art. The metal sleeve 18 is grounded by wire 19.

The high tension wire 16 passes through hollow cylindrical section 14 and is connected to plate 22. Plate 22 is in electrical contact with compression spring 24.

FIG. 1 illustrates one end of neon tube 30 which contains an electrode 32 at one end thereof and is adapted to be telescoped into one end of the electrical receptacle 10 so as to make contact with compression spring 24, plate 22, and high tension wire 16.

The other end of neon tube 30 (not shown) is adapted to be telescoped within another electrode receptacle (not shown) identical to the one illustrated in FIG. 1.

Once the neon tube 30 is inserted as described, neon tube 30 is fixedly retained anchored to the building wall 20 by means of a support and tie wires 40.

The electrode receptacle 10 is made of a plastic made from polycarbonate resins. The polycarbon plastic utilized in the present invention is flame retardant such as identified by the trademark Merlon 6455 having the following physical properties:

| | |
|---|---|
| Density | 1.2 Mg/m$^3$ |
| Melt Flow Rate (300° C.-1200 g Load) | 9-12 g/10 m |
| Tensile Stress at Yield | 63 MPa |
| Tensile Stress at Break | 68 MPa |
| Deflection Temperature Under Load at 1.8 MPa | 133° C. |
| Dielectric Strength | Greater Than 16 kV/mm |

It has been found that by utilizing polycarbon plastics in the manufacture electrode receptacles, the chances of cracking electrode receptacle 10 is minimized as polycarbon plastic is not as fragile as glass or porcelain. Accordingly, less arching problems occur with the utilization of electrode receptacles made from polycarbon plastics than with glass or porcelain.

Furthermore, it has been found that electrode receptacles made from polycarbon plastics and specifically Merlon 6455 resist the fromation of cracking which may occur in glass and porcelain when very high voltages are turned on particularly when rain water or water droplets accumulate in the electrode receptacle. Under such conditions, the sudden surge of a very high voltage "frys" the water within the electrode receptacle to very high temperatures so as to vaporize same. The almost instantaneous temperature differential which occurs in the water collected in the electrode receptacles tends to enchance the formation of cracks in the electrode receptacles made from glass or porcelain. It has been found that electrode receptacles 10 made from polycarbon resist the formation of cracks due to the sudden surge of high voltages to the collected water.

Moreover, it has been found that the polycarbon resins will melt over compression spring 24, plate 22 and high tension wire 16 when exposed to elevated temperatures such as during a fire so as to create an insulating coating over same, thereby minimizing the exposure of "live wires" having a very high voltage. Electrode receptacles made of glass or porcelain tend to crack under such conditions thereby enhancing arcing and exposing an electrical hazard.

The electrical receptacles made from polycarbon plastics may be produced in one piece by plastic extrusion methods in a highly mechanized manner so as bring down the cost of manufacture. For example, electrode receptacles made from polycarbon plastics may be manufactured for approximately one-third to one-quarter the cost of electrical receptacles made from glass or porcelain.

electrode receptacles made from glass a illustrated in FIG. 1 are typically made intwo separate pieces namely cylindrical sections 12 and 14 which are melted and fused together in the area of common contact marked 13. This prodecure is relatively costly and time consuming and the melted zone 13 presents an area of weakness. Electrode receptacles made from polycarbon resins on the other hand may be made in one piece by extrusion means in a fast and efficient manner.

Electrode receptacles made from heat resistant glass have a tendency to crack when subjected to a thermal shock test by exposing same to a temperature differential between 0° C. and 100° C. repetitively five times. Electrode receptacles made of Pyrex glass usually withstand such thermal shock tests although Pyrex glass is relatively expensive relative to electrode receptacles made from polycarbon plastics. It has been found that electrode receptacles made of Merlon 6455 successfully pass thermal shock tests between −42° C. to 100° C.

As described earlier the compression springs which have been used before have a tendency to loss their resiliency and eventually no longer contact electrode 32 of neon tube 30 after prolonged usage as illustrated by the hiddne lines in FIG. 1. (The gap between the compression spring represented by the hidden lines in FIG. 1 at the electrode 32 has been exaggerated for illustration purposes).

It has been found that this condition may be delayed by using heat tempered compression springs. More specifically it has been found that if a straight piece of PH Bronze also known as Foster Bronze is spun into the shape of the coil and then heat tempered at 400° C. for ½ hour and then air cooled to room temperature the resulting compression spring exhibits superior compression characteristics even after prolonged exposure to temperature changes between −42° C. and 450° C. resulting in a longer effective life of the compression spring and the neon tube since the compression spring contacts the electrode 32 for a longer period of time than compression springs which are not heat tempered. This delays the destructive action of the arcing between the compression spring 24 and electrode 32.

It has been found that electrode receptacle made of Merlon 6455 having a thickness of 3/16 inch walls are suitable.

Although the preferred embodiments, as well as the operation and use have been specifically described in relation to the drawings, it should be understood that variations in the preferred embodiments could easily be achieved by a skilled man in a trade without departing from the spirit of the invention. Accordingly, the invention should not be understood to be limited to the exact form revealed in the drawings.

The embodiments of the invention in which an exclusive property or privilege is claimed are defined as follows:

1. In an electrical receptacle having a generally hollow cylindrical section for receiving high tension wire means at one end and light means at another end, said light means adapted for electrical connection with said high tension wire means interiorally of said hollow cylindrical section, said hollow cylindrical section comprised of carbonate resin plastic for resisting sudden heat increases within said hollow cylindrical section in the region of said electrical contact with said light means and said high tension wire means wherein said carbonate resin plastic has a melt flow of 9 to about 12 g/10m at 300 degrees Centigrade and 1,200 g load and tensile stress at yield of 63 MPa, a tensile stress at break of 68 MPa, a deflection temperature under load at 1.8 MPa of 133 degrees Centigrade and a dielectric strenght of greater than 16 KV/mm.

2. In a neon receptacle for connecting a high voltage connector to a neon tube, said receptacle having a generally hollow cylindrical section for receiving said high voltage conductor at one end of said hollow cylindrical section and said neon tube at another end, said neon tube adapted for electrical contact with said high voltage conductor internally of said hollow cylindrical section, said hollow cylindrical section comprised of polycarbonate resin plastic for resisting sudden heat increases within said hollow cylindrical section int he region of said electrical contact between said neon tube and said high voltage conductor wherein said polycarbonate resin plastic has, a melt flow of about 9 to 12 g/10m at about 300 degrees Centigrade at about 1,200 g load, a tensile stress at yield of about 63 MPa, a tensile stress at break of about 68 MPa, a deflection temperature under load of about 1.8 MPa at about 133 degrees Centigrade and a dielectric strength of greater than 16 KV/mm.

3. In a neon receptacle as claimed in claim 2 wherein said polycarbonate resin plastic is adapted to melt over said high voltage conductor for minimizing electrical hazards when said receptacle is exposed to elevated temperatures.

4. In a neon receptacle as claimed in claim 3 including a heat tempered compression spring disposed interiorly of said receptacle and adapted for connection to said high voltage conductor and for contact with said neon tube.

5. In a neon receptacle as claimed in claim 4 wherein said compression spring is comprised of pH bronze.

6. In a neon receptacle for connection a high voltage conductor to a neon tube said receptacle including:

(a) generally hollow cylindrical section, said section having an opening at one end thereof for receiving said neon tube and an aperture at the other end thereof adapted for receiving said high voltage conductor interiorly of said section;

(b) a compression spring disposed interiorly of said tube adapted for connection to said high voltage conductor for conducting electrical energy from said high voltage conductor to said neon tube;

(c) said hollow cylindrical section comprised of polycarbonate resin plastic for resisting sudden heat increases within said hollow cylindrical section in the region of said electrical contact between the said neon tube and said high voltage conductor;

(d) wherein said polycarbonate resin plastic has a density of 1.2 mg/m$^3$, melt flow rate of 9 to about 12 g/10m at 300 degrees Centigrade and 1,200 g load, and a tensile stress at yiedl fo 63 MPa, a tensile stress at break of 68 MPa, a deflection temperature underload at 1.8 MPa of 133 degrees Centigrade and a dielectric strenght of greater than 16 kV/mm.

7. In a neon receptacle as claimed in claim 6 wherein said compression spring is comprised of pH bronze.

8. In an electrical receptacle as claimed in claim 1 wherein said carbonate resin is comprised of polycarbonate resin plastic and is flame retardant.

9. In an electrical receptacle as claimed in claim 8 wherein said receptacle is adapted to resist deformation when exposed to repeated temperature variations between minus 35 degrees Centigrade to 100 degrees Centigrade.

10. In an electrical receptacle as claimed in claim 8 wherein said electrode receptacle is comprised of polycarbonate plastic adapted to resist deformation when exposed to repeated temperature variations.

11. In a neon receptacle as claimed in claim 6 wherein said generally hollow cylindrical section comprises:

(a) a first cylindrical section having a first internal diameter; and (b) a second cylindrical section having a second internal diameter.

12. In a noen receptacle as claimed in claim 11 wherein said first diameter is smaller than said second diameter, and said first cylindrical section is directly connected to said second cylindrical section, and said first cylindrical section is adapted to receive said high voltage conductor, and said second cylindrical section is adapted to receive said neon tube and said compression spring.

13. In a neon receptacle for connecting a high voltage conductor to a neon tube said receptacle including:

(a) a generally hollow cylindrical section, said section having an opening at one end thereof for receiving said neon tube and an aperture at the other end thereof adapted for receiving said high voltage conductor interiorally of said section;

(b) a compression spring disposed interiorally of said tube adapted for connection to said high voltage conductor for conducting electrical energy from said high voltage conductor to said neon tube;

(c) said hollow cylindrical section comprised of carbonate resin plastic for resisting sudden heat increases within said hollow cylindrical section in the region of said electrical contact between said neon tube and said high voltage conductor;

(d) said carbonate resin plastic having a density of 1.2 mg/m$^3$, melt flow rate of 9 to about 12 g/10m at 300 degrees Centigrade and 1,200 g load, and a tensile stress at yield of 63 MPa, a tensile stress at break of 68 MPa, a deflection temperature underload at 1.8 MPa of 133 degrees Centigrade and a dielectric strength of greater than 16 kV/mm.

14. In a neon receptacle as claimed in claim 13 wherein said generally hollow cylindrical section comprises:

(a) a first cylindrical section having a first internal diameter; and (b) a second cylindrical section having a second internal diameter.

15. In a neon receptacle as claimed in claim 14 wherein said first diameter is smaller than said second diameter, and said first cylindrical section is directly connected to said second cylindrical section, and said first cylindrical section is adapted to receive said high voltage conductor, and said second cylindrical section is adapted to receive said neon tube and said compression spring.

* * * * *